US005716256A

United States Patent [19]

Mizuno et al.

[11] Patent Number: 5,716,256

[45] Date of Patent: Feb. 10, 1998

[54] LENS GRINDING APPARATUS FOR GRINDING AN EYEGLASS LENS FROM A PLURALITY OF DIRECTIONS

[75] Inventors: Toshiaki Mizuno; Ryoji Shibata; Masahiko Kobayashi; Yoshinori Matsuyama; Hirokatsu Ohbayashi; Masakazu Funakura, all of Aichi, Japan

[73] Assignee: Nidek Co., Ltd., Gamagori, Japan

[21] Appl. No.: 679,482

[22] Filed: Jul. 12, 1996

[30] Foreign Application Priority Data

Mar. 26, 1996 [JP] Japan ..... 8-097444

[51] Int. Cl.[6] ..... B24B 9/14

[52] U.S. Cl. ..... 451/5; 451/43; 451/210

[58] Field of Search ..... 451/43, 5, 14, 451/10, 210, 255, 256, 209, 197, 195

[56] References Cited

U.S. PATENT DOCUMENTS

| | | | |
|---|---|---|---|
| 1,521,116 | 12/1924 | Miller | 451/210 |
| 2,612,734 | 10/1952 | Taig | 451/210 |
| 2,685,153 | 8/1954 | Ellis | 451/210 |
| 2,748,541 | 6/1956 | Connell | 451/210 |
| 3,158,967 | 12/1964 | Reaser | 451/210 |
| 4,766,699 | 8/1988 | Gottschald et al. | 51/101 |
| 5,228,242 | 7/1993 | Matsuyama | 51/165 |
| 5,333,412 | 8/1994 | Matsuyama | 51/165 |
| 5,347,762 | 9/1994 | Shibata et al. | 451/15 |

FOREIGN PATENT DOCUMENTS

| | | | |
|---|---|---|---|
| 3-20603 | 1/1991 | Japan | G01B 5/06 |

*Primary Examiner*—Robert A. Rose

*Attorney, Agent, or Firm*—Sughrue, Mion, Zinn, Macpeak & Seas, PLLC

[57] ABSTRACT

A subject lens is held by two chuck shafts, which are rotated synchronously by pulse motors during a grinding operation. A group of grinding wheels are mounted on each of rotary shafts of right and left lens grinding parts. The rotary shafts are disposed on opposite sides of the chuck shafts. A desired grinding wheel for each processing is selected by moving the rotary shaft vertically. To grind the subject lens, the rotary shafts are moved independently by pulse motors toward the rotation axis of the chuck shafts based on lens frame shape data in the case of rough processing.

19 Claims, 8 Drawing Sheets

LENS GRINDING APPARATUS FOR GRINDING AN EYEGLASS LENS FROM A PLURALITY OF DIRECTIONS

BACKGROUND OF THE INVENTION

1. Field of the Invention

The present invention relates to a lens grinding apparatus which is used to grind an eyeglass lens so that it fits into an eyeglasses frame.

2. Description of the Related Art

In an optician's shop, an optician processes the edge of each eyeglass lens so that it fits into an eyeglasses frame selected by a customer, and then mounts the processed lenses into the frame. For this purpose, an optician's shop has been equipped with a lens grinding apparatus for grinding the edge of an eyeglass lens. In general, a lens grinding apparatus to be used in an optician's shop has plural kinds of grinding wheel for lens grinding which are mounted on a single rotary shaft at given positions and can be rotated at high speed, and a carriage for rotatably holding a subject lens by means of lens rotary shafts. By rotating the subject lens being held by the carriage on the rotary axis of the carriage, it is brought into contact with the grinding wheel and ground.

In recent years, with the streamlining of management and the progress of the communications technology, processing centers in which lens processing operations including bevel processing are performed intensively have come to be established. In the processing center, also the edge of an eyeglass lens that has not been processed yet for fitting into an eyeglasses frame is further processed in accordance with a request from an optician's shop.

The processing center is required to process a large number of lenses with high precision in a short time. However, the conventional lens grinding apparatuses are not high in mechanical rigidity and take a long processing time.

SUMMARY OF THE INVENTION

In view of the above, it is an object of the present invention to provide a lens grinding apparatus which can process a large number of lenses with high precision in a short time.

It is another object of the invention to provide a highly durable lens grinding apparatus.

To attain the above objects, according to the invention, there is provided a lens grinding apparatus for performing frame-fit processing on an eyeglass lens, comprising:

- input means for receiving data necessary to produce frame-fit processing data;
- lens holding shafts for holding a subject lens in between;
- means for rotating the lens holding shafts;
- a plurality of grinding-wheel shafts on each of which at least one grinding wheel for lens grinding is mounted;
- means for rotating each of the plurality of grinding-wheel shafts;
- first moving means for moving the plurality of grinding-wheel shafts toward a rotation axis of the lens holding shafts, to grind the subject lens; and
- control means for controlling the grinding-wheel shafts moving means based on the frame-fit processing data.

DESCRIPTION OF THE PREFERRED EMBODIMENT

A lens grinding apparatus according to an embodiment of the present invention will be hereinafter described with reference to the accompanying drawings.

Configuration of Whole Apparatus

Figure 1:
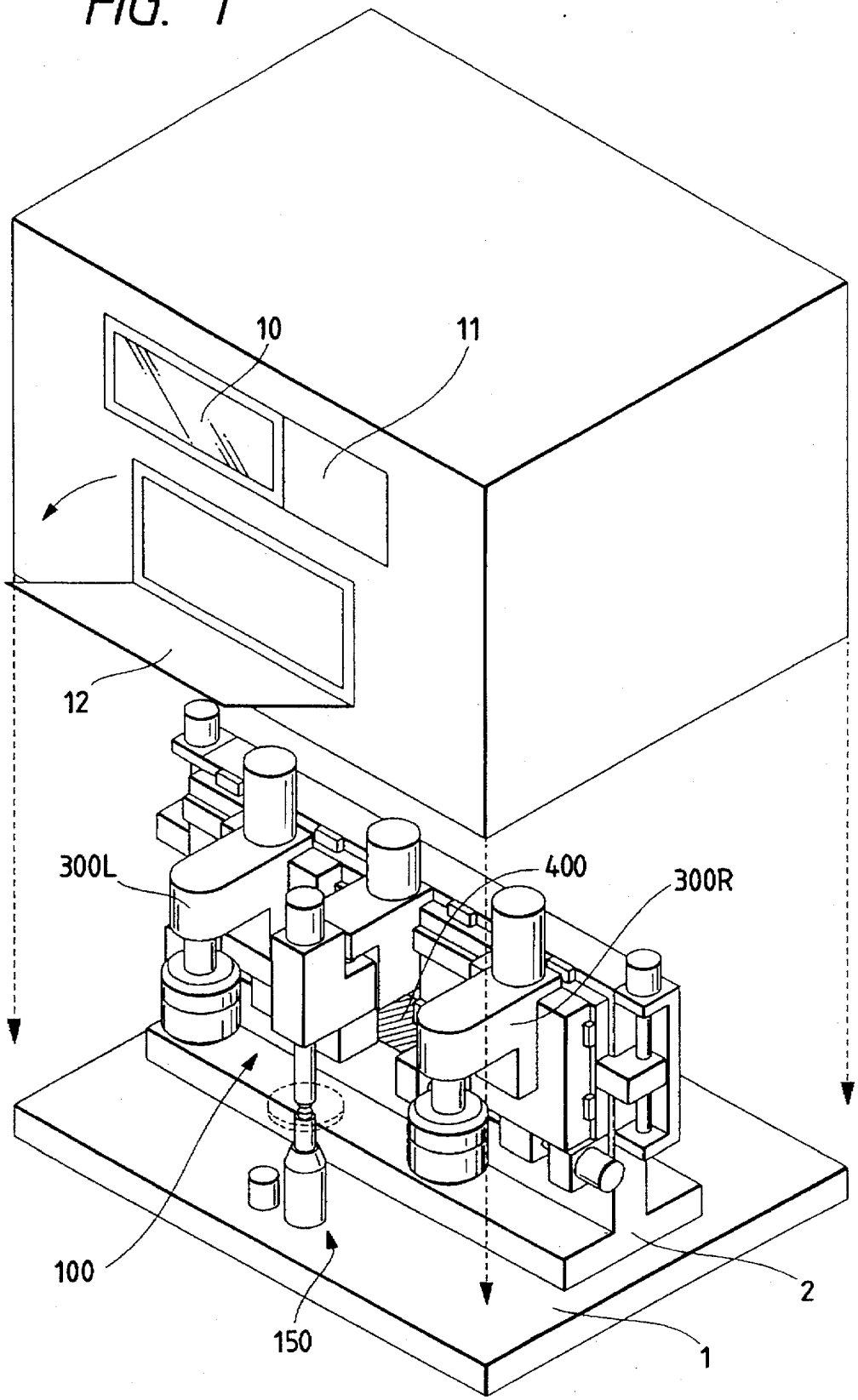
FIG. 1 is a perspective view of the entire configuration of a lens grinding apparatus according to an embodiment of the present invention.

In FIG. 1, reference numeral 1 denotes a main base, and 2 denotes a sub-base that is fixed to the main base 1. A lens chuck upper part 100 and a lens chuck lower part 150 hold a subject lens by means of their respective chuck shafts during processing it. A lens thickness measuring section 400 is accommodated below the lens chuck upper part 100 in the depth of the sub-base 2.

Figure 2:
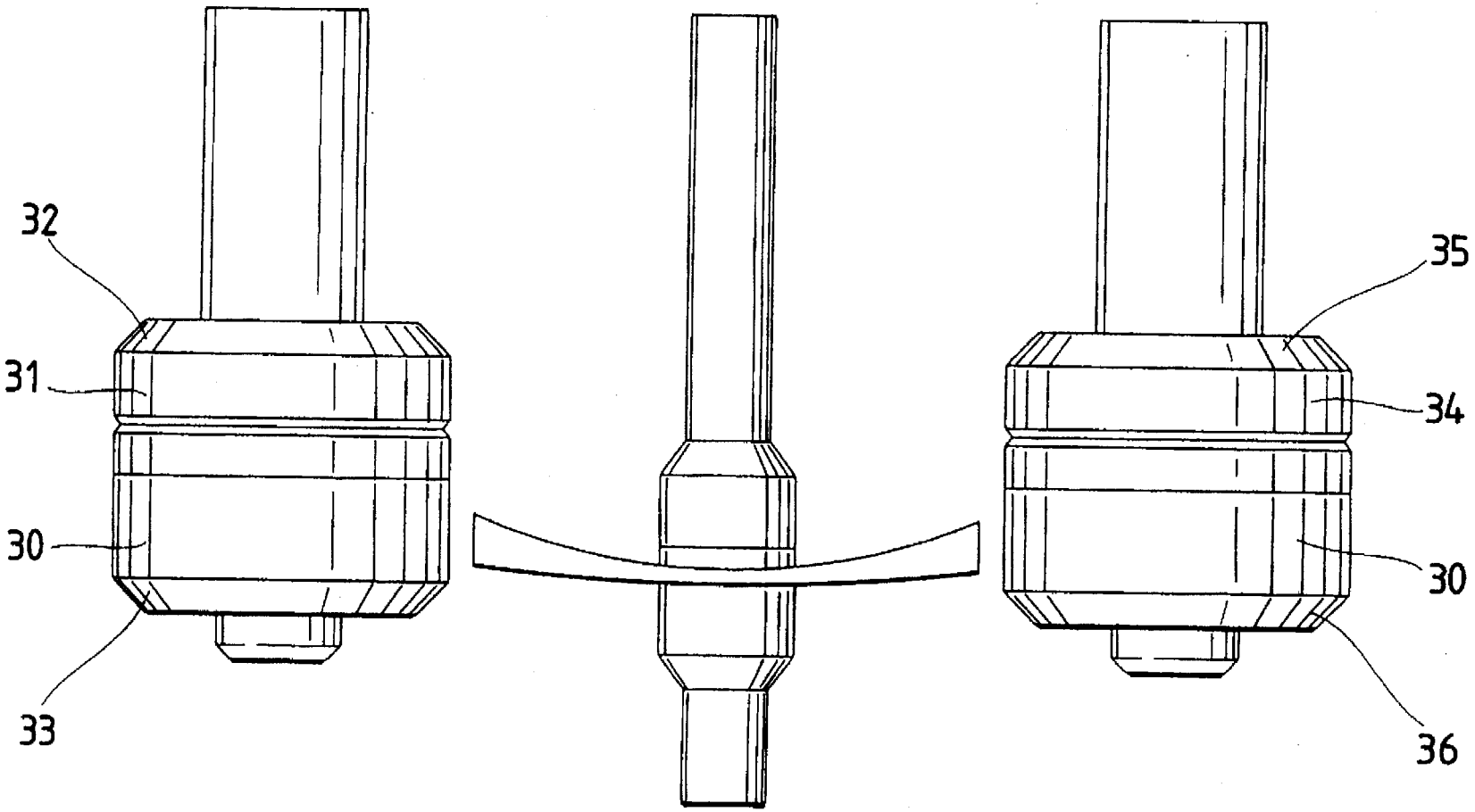
FIG. 2 shows the arrangement of grinding wheels used in the apparatus of FIG. 1.

Reference symbols 300R and 300L respectively represent right and left lens grinding parts each having grinding wheels for lens grinding on its rotary shaft. Each of the lens grinding parts 300R and 300L is held by a moving mechanism (described later) so as to be movable in the vertical and horizontal directions with respect the sub-base 2. As shown in FIG. 2, a rough grinding wheel 30 for plastics and a finishing grinding wheel 31 are mounted on the rotary shaft of the lens grinding part 300L. Further, a front surface chamfering grinding wheel 32 having a conical surface is coaxially attached to the upper end surface of the fishing grinding wheel 31, while a rear surface chamfering grinding wheel 33 having a conical surface is coaxially attached to the lower end surface of the rough grinding wheel 30. On the other hand, a mirror-finishing grinding wheel 34 is mounted on the rotary shaft of the lens grinding part 300R. A rough grinding wheel 30 for plastics which is the same as that of the lens grinding part 300L, a front surface mirror-chamfering grinding wheel 35 having a conical surface, and a rear surface mirror-chamfering grinding wheel 36 having a conical surface are coaxially mounted on the rotary shaft of the lens grinding part 300R. The diameter of these grinding wheels are relatively small, that is, about 60 mm.

A display unit 10 for displaying processing data and other information and an input unit 11 for allowing a user to input data or an instruction to the lens grinding apparatus are provided in the front surface of a body of the apparatus. Reference numeral 12 denotes a closable door.

Structures of Main Parts

<Lens Chuck Part>

Figure 3:
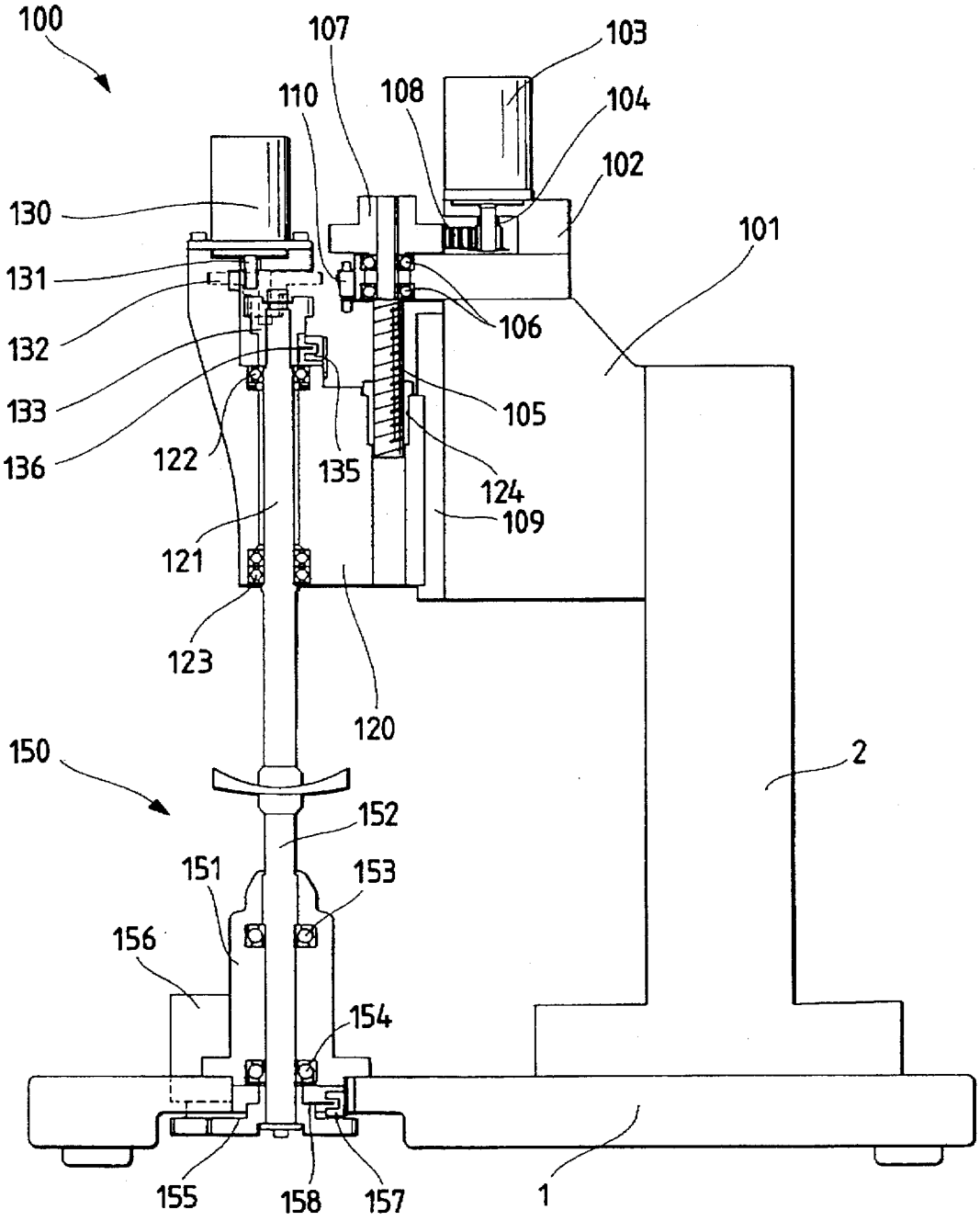
FIG. 3 is a side view showing a lens chuck upper part 100 and a lens chuck lower part 150.

FIG. 3 illustrates the lens chuck upper part 100 and the lens chuck lower part 150.

(1) Lens Chuck Upper Part

A fixing block 101 is fixed to the sub-base 2. A DC motor 103 is mounted on top of the fixing block 101 by means of a mounting plate 102, and a pulley 104 is attached to the rotary shaft of the DC motor 103. A feed screw 105 is rotatably held by the fixing block 101 through a bearing 106, and a pulley 107 is attached to the upper end of the feed screw 105. A timing belt 108 engages with the two pulleys 104 and 107.

A chuck shaft 121 is rotatably held by a chuck shaft holder 120 through bearings 122 and 123. A nut 124 that is threadedly engaged with the feed screw 105 is fixed to the chuck shaft holder 120. Also, the chuck shaft holder 120 is formed with a guide groove along a vertically extending guide rail 109 that is fixed to the fixing block 101. The rotational force of the DC motor 103 is transmitted to the feed screw 105 via the pulley 104, timing belt 108, and pulley 107. When the feed screw 105 is rotated, the nut 124 that is threadedly engaged with the feed screw 104 causes the chuck shaft holder 120 to move vertically being guided by the guide rail 109. A micro switch 110, which is attached to the fixing block 101, detects a reference position when the chuck shaft holder 120 is elevated.

A pulse motor 130 for rotating the chuck shaft 121 is fixed to the top portion of the chuck holder 120. The rotational force of the pulse motor 130 is transmitted, via a gear 131 that is attached to its rotary shaft and a relay gear 132, to a gear 133 that is attached to the chuck shaft 121, to rotate the chuck shaft 121.

Reference numeral 135 denotes a photosensor and 136 denotes a light-shielding plate that is mounted on the chuck shaft 121. The photosensor 135 detects a rotation reference position of the chuck shaft 121.

(2) Lens Chuck Lower Part

A lower chuck shaft 152 is rotatably held by a chuck shaft holder 151 through bearings 153 and 154, and the chuck shaft holder 151 is fixed to the main base 1. A gear 155 is fixed to the bottom end of the chuck shaft 152. The rotational force of a pulse motor 156 is transmitted to the chuck shaft 151 to the chuck shaft 121 by a gear arrangement (not shown) that is similar to the counterpart in the upper chuck part, to rotate the chuck shaft 151.

Reference numeral 157 denotes a photosensor and 158 denotes a light-shielding plate that is mounted on the gear 155. The photosensor 157 detects a rotation reference position of the lower chuck shaft 151.

<Moving Mechanism for Lens Grinding Part>

Figure 4:
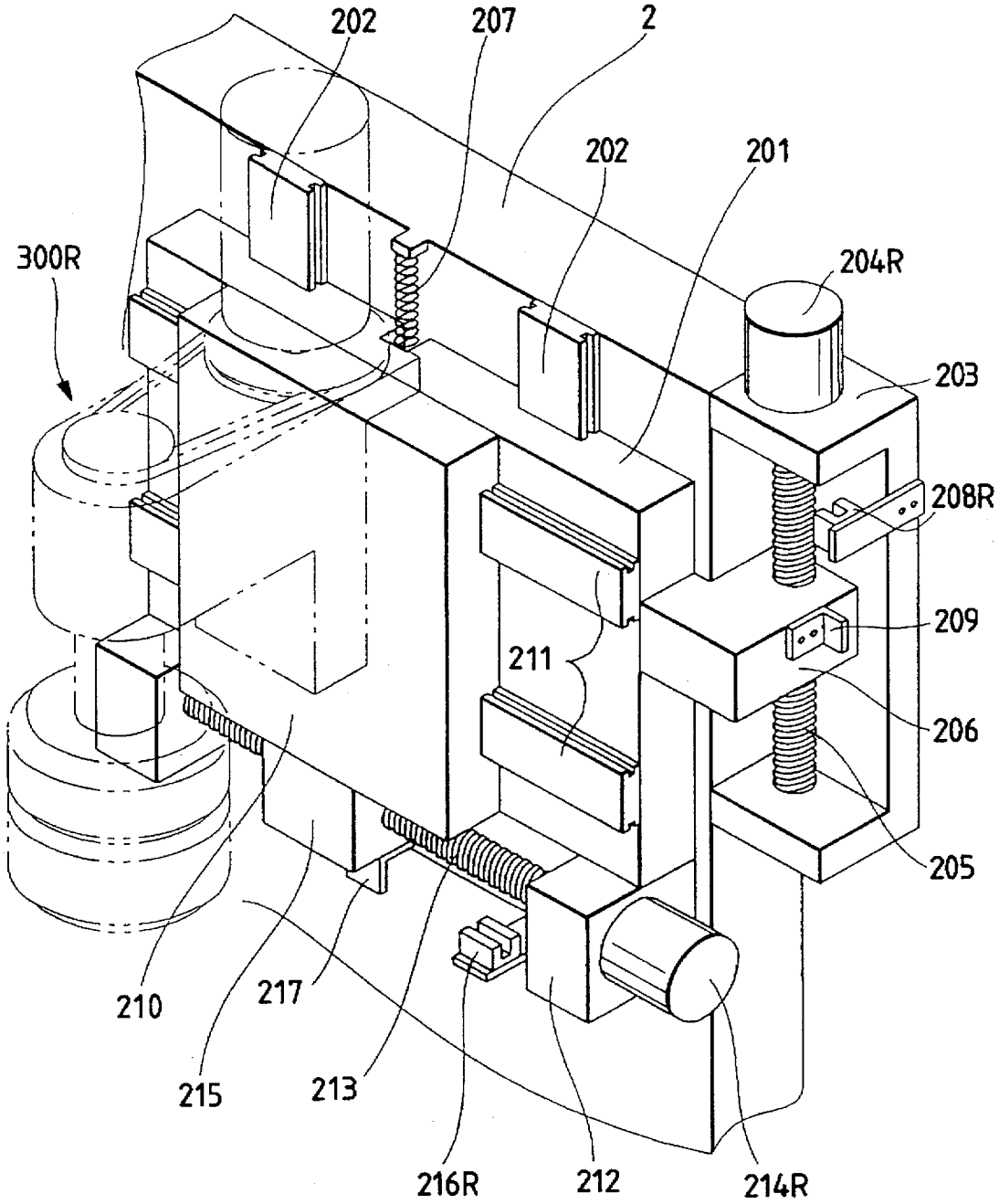
FIG. 4 is a perspective view of a mechanism for moving a lens grinding part 300R.

FIG. 4 illustrates a mechanism for moving the right lens grinding part 300R. (Since a moving mechanism for the left lens grinding part 300L is symmetrical with the right lens grinding part 300R, it will not be described.)

A vertical slide base is vertically slidable along two guide rails 202 that are fixed to the front surface of the sub-base 2. A vertically moving mechanism for the vertical slide base 201 is structured as follows. A bracket-shaped screw holder 203 is fixed to the right side surface of the sub-base 2. A pulse motor 204R is fixed to the surface of the screw holder 203, and a ball screw 205 that is rotatably held by the screw holder 203 is coupled to the rotary shaft of the pulse motor 204R. A nut block 206 has a nut which is threadedly engaged with the ball screw 205, and is fixed to the side surface of the vertical slide base 201. When the pulse motor 204R rotates the ball screw 205, the vertical slide base 201 is moved accordingly in the vertical direction being guided by the guide rails 202. A spring 207 is provided between the sub-base 2 and the vertical slide base 201. That is, the spring 207 urges the vertical slide base 201 upward to cancel out the downward load of the vertical slide base 201, thereby facilitating its vertical movement.

A photosensor 208R is fixed to the screw holder 203, and a light-shielding plate 209 is fixed to the nut block 206. The photosensor 208R determines a reference position of the vertical movement of the vertical slide base 201 by detecting the position of the light-shielding plate 209.

The lens grinding part 300R is foxed to a horizontal slide base 210. The horizontal slide base 210 is slidable in the horizontal direction along two slide guide rails 211 that are fixed to the front surface of the vertical slide base 201. A mechanism for moving the horizontal slide base 210 is basically the same as the above-described moving mechanism for the vertical slide base 201. A bracket-shaped screw holder 212 is fixed to the bottom surface of the vertical slide base 201, and holds a ball screw 213 rotatably. A pulse motor 214R is fixed to the side surface the screw holder 212, and the ball screw 213 is coupled to the rotary shaft of the pulse motor 214R. The ball screw 213 is in threaded engagement with a nut block 215 that is fixed to the bottom surface of the horizontal slide base 210. When the pulse motor 214R rotates the ball screw 213, the horizontal slide base 210 that is fixed to the nut block 215 is moved accordingly in the horizontal direction along the guide rails 211.

A photosensor 216R is fixed to the screw holder 212, and a light-shielding plate 217 is fixed to the nut block 215. The photosensor 216R determines a reference position of the horizontal movement of the horizontal slide base 210 by detecting the position of the light-shielding plate 215.

<Lens Grinding Part>

Figure 5:
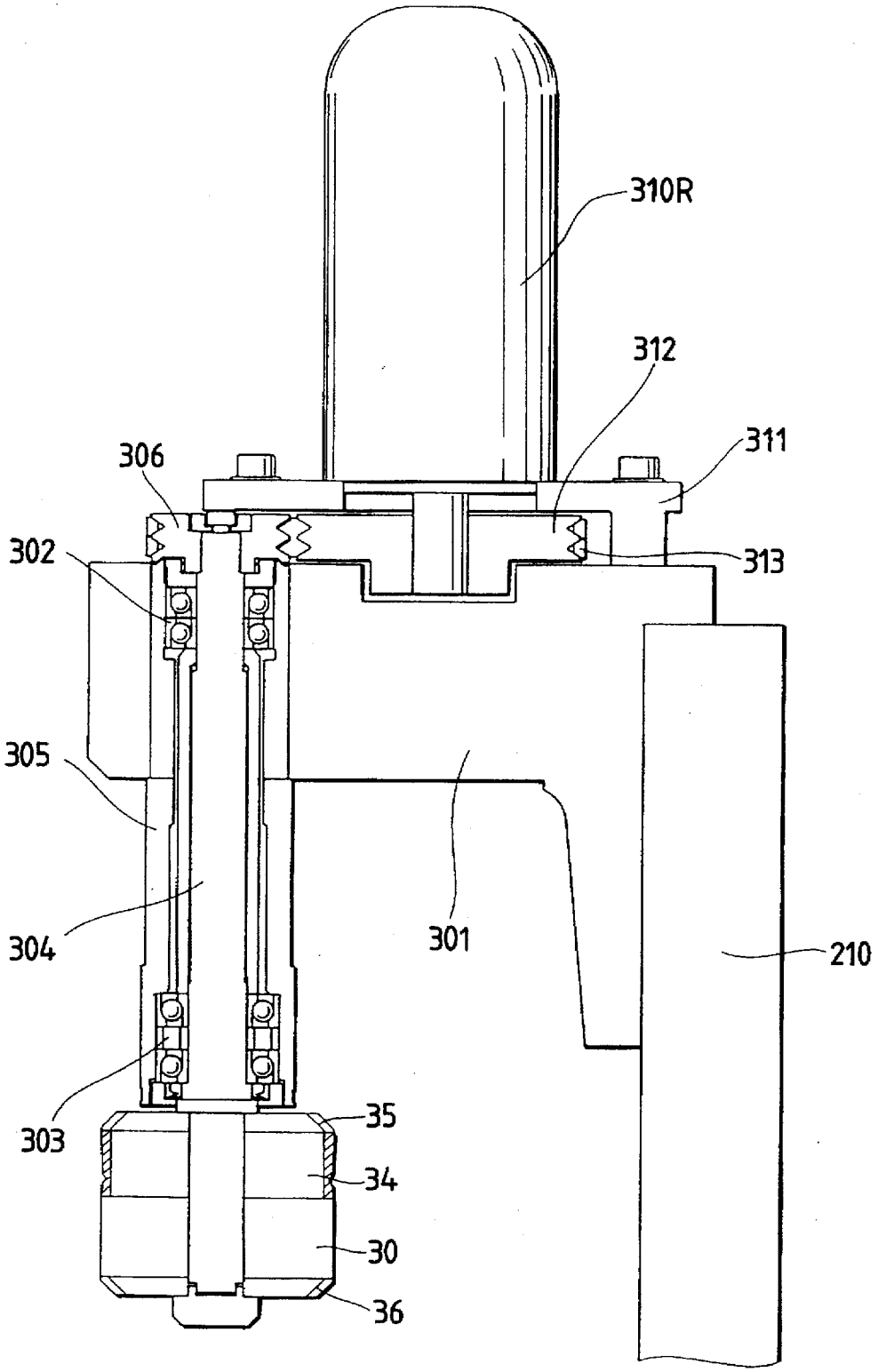
FIG. 5 is at side sectional view of the lens grinding part 300R.

FIG. 5 is a side sectional view showing the structure of the right lens grinding part 300R.

A shaft support base 301 is fixed to the horizontal slide base 210. A housing 305 is fixed to the front portion of the shaft support base 301, and rotatably holds therein a vertically extending rotary shaft 304 through bearings 302 and 303. A group of grinding wheels including a rough grinding wheel 30 are mounted on the lower portion of the rotary shaft 304.

A servo motor 310R for rotating the grinding wheels is fixed to the top surface of the shaft support base 301 through a mounting plate 311. A pulley 312 is attached to the rotary shaft of the servo motor 310R, and coupled, via a belt 313, to another pulley 306 that is attached to the upper end of the rotary shaft 304. With this structure, when the servo motor 310R rotates, the grinding wheels that are mounted on the rotary shaft 304 are rotated accordingly.

Since the left lens grinding part 300L is symmetrical with the right lens grinding part 300R, its structure will not be described.

With the driving control on the pulse motors of the above-described moving mechanisms, each of the right and left lens grinding parts 300R and 300L is moved vertically and horizontally with respect to a subject lens being is held by the upper and lower chuck shafts 121 and 152. These movements of the right and left grinding parts 300R and 300L bring selected ones of the grinding wheels into contact with the subject lens, so that the selected grinding wheels grind the subject lens. Since the lens grinding apparatus includes the two groups of grinding wheels respectively mounted on the two rotary shafts thereof, it can grind the subject lens from the two directions at the same time (details of the grinding operation will be described later). It is noted that in this embodiment the rotation axis of the chuck shafts 121 and 152 of the lens chuck upper part 100 and the lens chuck lower part 150 is so arranged as to be located on the straight line connecting the centers of the two respective shafts 304 of the lens grinding parts 300R and 300L (see FIG. 6).

<Lens Thickness Measuring Section>

Figure 7:
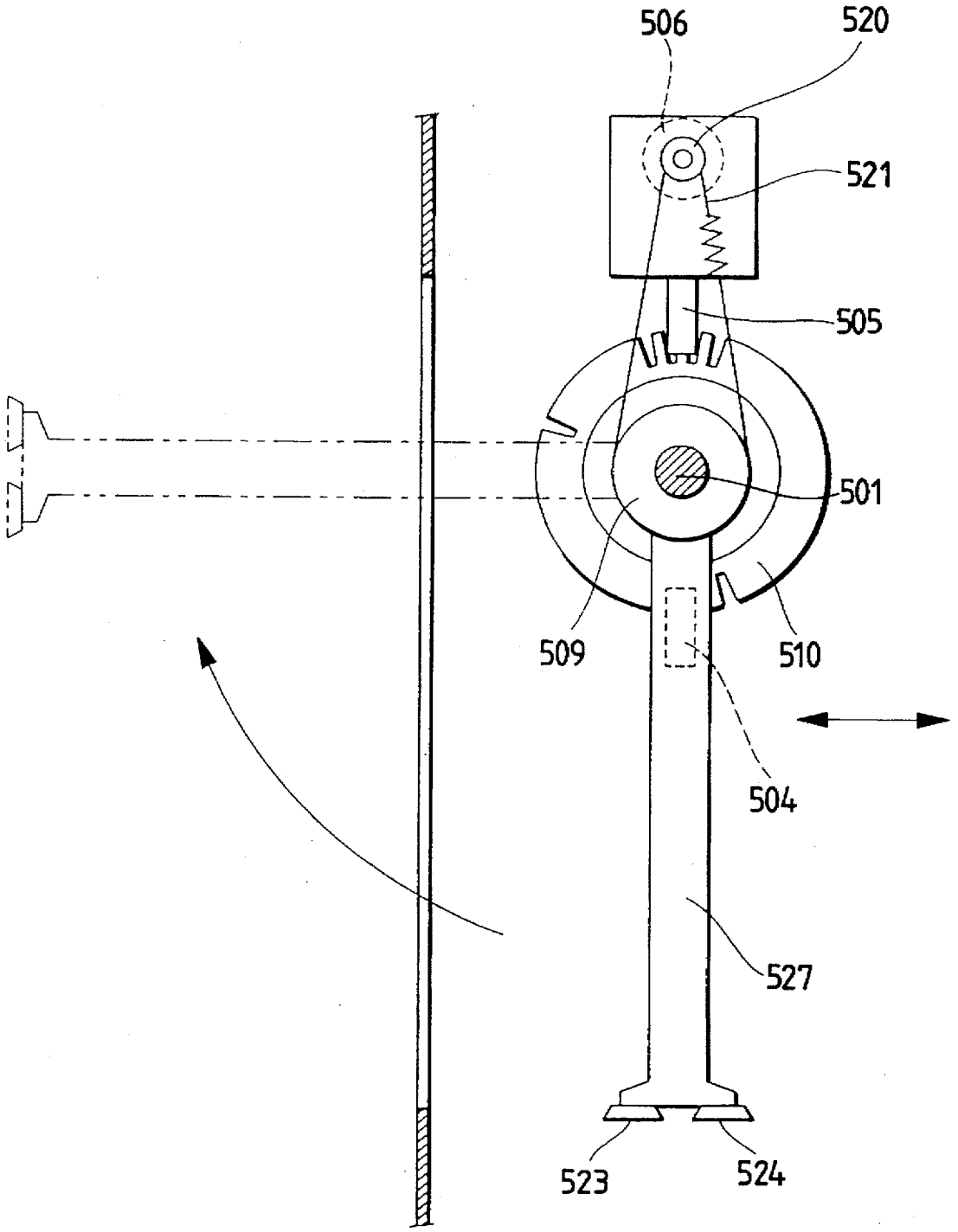
FIG. 7 illustrates the operation of a lens thickness measuring section 400.

FIG. 7 illustrates the lens thickness measuring section 400.

The lens thickness measuring section 400 includes a measuring arm 527 having two rotatable feelers 523 and 524, a rotation mechanism such as a DC motor (not shown) for rotating the measuring arm 527, a sensor plate 510 and photo-switches 504 and 505 for detecting the rotation of the measuring arm 527 to thereby allow control of the rotation of the DC motor, a detection mechanism such as a potentiometer 506 for detecting the amount of rotation of the measuring arm 527 to thereby obtain the shapes of the front and rear surfaces of the subject lens. The configuration of the lens thickness measuring section 400 is basically the same as that disclosed in Japanese Unexamined Patent Publication No. Hei. 3-20603 and U.S. Pat. No. 5,333,412 filed by or assigned to the present assignee, which are referred to for details of the lens thickness measuring section 400. The lens thickness measuring section 400 of FIG. 7 is so controlled as to move in front-rear direction (indicated by arrows in FIG. 7) relative to the lens grinding apparatus by a front-rear moving means 401 based on measurement data of a lens shape measuring apparatus. The lens thickness is measured such that the measuring arm 527 is rotated upward from its lower initial position and the feelers 523 and 524 are respectively brought into contact with the front and rear refraction surfaces of the lens. Therefore, it is preferable that the rotary shaft of the measuring arm 527 be equipped with a coil spring or the like which cancels out the downward load of the measuring arm 527.

The lens thickness (edge thickness) measurement is performed in the following manner. First, the lens thickness measuring section 400 is moved forward or backward by the front-rear moving means, and the measuring arm 527 is rotated, that is, elevated. The shape of the lens front refraction surface is obtained by rotating the lens while keeping the feeler 523 in contact with the lens front refraction surface (bevel bottom (or bevel top)). Then, the shape of the lens rear refraction surface is obtained by rotating the lens while keeping the feeler 524 in contact with the lens rear refraction surface to (this operation is basically the same as disclosed in Japanese Unexamined Patent Publication No. Hei. 3-20603 and U.S. Pat. No. 5,333,412 mentioned above).

<Control System>

Figure 8:
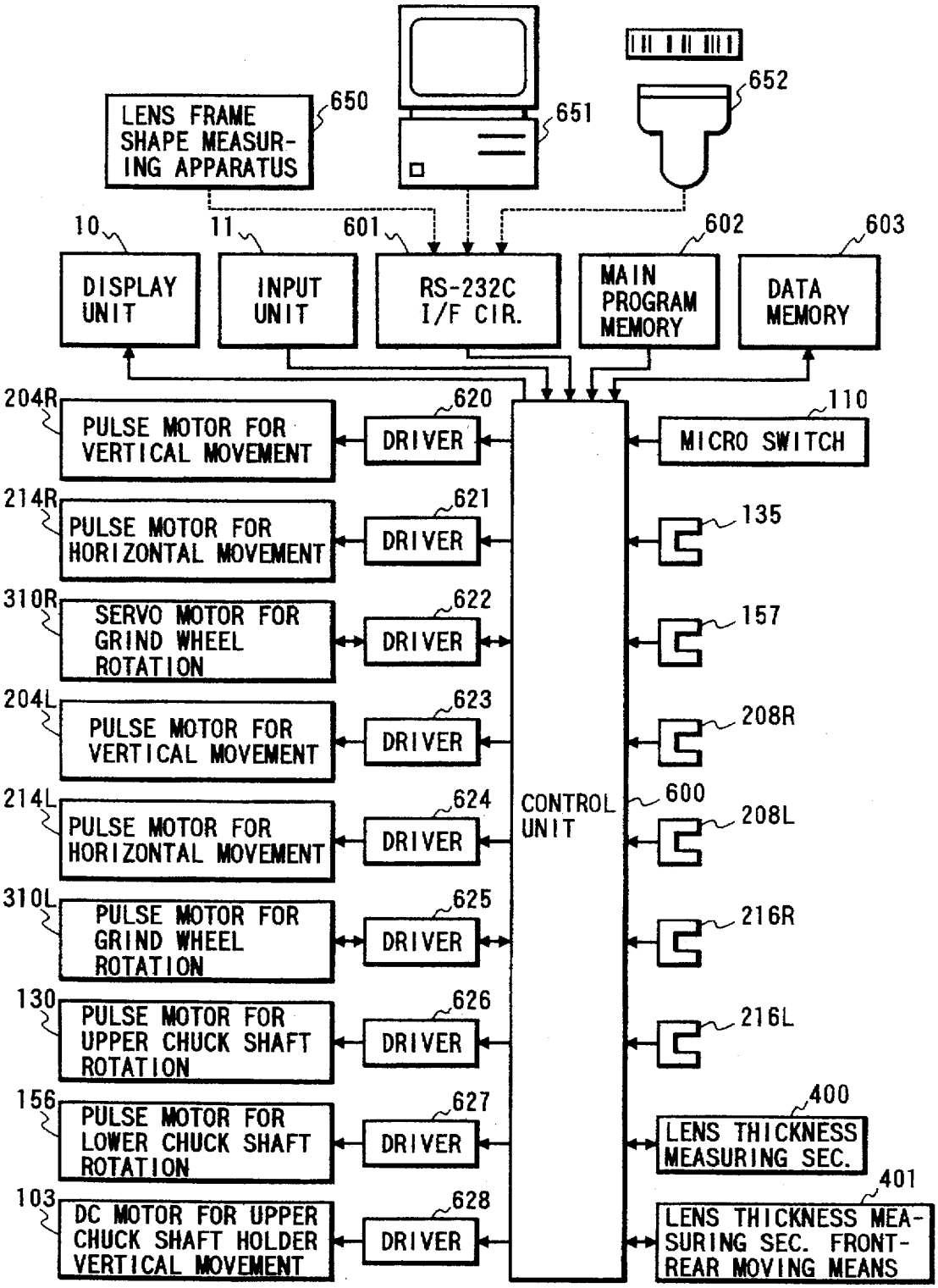
FIG. 8 is a block diagram showing a general configuration of a control system of the apparatus of FIG. 1.

FIG. 8 is a block diagram showing a general configuration of a control system of the lens grinding apparatus.

Reference character 600 denotes a control unit which controls the whole apparatus. The display unit 10, input unit 11, micro switch 110, and photosensors are connected to the control unit 600. The motors for moving or rotating the respective parts are connected to the control unit 600 via drivers 620–628. The drivers 622 and 625, which are respectively connected to the servo motor 310R for the right lens grinding part 300R and the servo motor 310L for the left lens grinding part 300L, detect the torque of the servo motors 310R and 310L during the processing and feed back the detected torque to the control unit 600. The control unit 600 uses the torque information to control the movement of the lens grinding parts 300R and 300L as well as the rotation of the lens.

Reference numeral 601 denotes an interface circuit which serves to transmit and receive data. A lens frame shape measuring apparatus 650, a host computer 651 for managing lens processing data, a bar code scanner 652, etc. may be connected to the interface circuit 601. A main program memory 602 stores a program for operating the lens grinding apparatus. A data memory 603 stores data that are supplied through the interface circuit 601, lens thickness measurement data, and other data.

Operation

The operation of the lens grinding apparatus having the above-described configuration will be hereinafter described. The following description will be directed to a case where various kinds of data including the data (three-dimensional configurational data on a lens frame shape and a template) of a lens shape measuring apparatus 650 (see U.S. Pat. No. 5,228,242, for instance) installed in each optician's shop, layout data (a distance between geometrical centers of both lens frame portions, a pupillary distance, etc.), a lens kind and strength data, and other data are transmitted through public communications lines to the host computer 651 which is provided in a processing center, and a lens is processed by the lens grinding apparatus according to the embodiment. It is assumed that the subject lens is a plastic lens, and that the lens is bevel-processed and then chamfered.

Data that have been transmitted to the host computer 651 are input to the control unit 600 via the interface circuit 601 and then transferred to and stored into the data memory 603. At the same time, the control unit 600 displays the received data on the display unit 10. An operator performs a given treatment on the subject lens, and places it on the chuck shaft 152. Upon completion of the preparation for processing, the operator depresses a start switch of the input unit 11 to start the processing. In response to a resulting start signal, the lens grinding apparatus automatically performs a lens edge thickness measurement, rough processing, bevel processing, and chamfering, which will be described below in order.

(1) Lens Edge Thickness Measurement

Upon receipt of the start signal, the control unit 600 drives the DC motor 103 to lower the chuck shaft holder 120, to thereby hold the subject lens by means of the chuck shafts 121 and 152. Next, the control unit 600 produces processing data which has the position of the lens optical axis as the origin based on the layout data, lens frame shape data, and other data. Edge information of the bevel top or bottom (preferably, the bevel bottom) is obtained in the edge thickness measurement of the subject lens. During the edge thickness measurement, the motors 130 and 156 are driven to rotate the subject lens being held by the chuck shafts 121 and 152. The motors 130 and 156 are rotation-driven in synchronism with each other under the control of the control unit 600. The control unit 600 produces data of bevel processing data to be performed on the lens according to a given program and based on the measurement data (edge information) that has been obtained by the lens measuring section 400. As for the calculation of the bevel processing data, there are proposed several methods including a method of calculating a curve from front and rear surface curves, a method of dividing the edge thickness, and a combination of these methods. For the details of the calculation of the bevel processing data, reference is made of, for instance, U.S. Pat. No. 5,347,762 filed by the present assignee. The bevel processing data thus obtained are stored in the data memory 603.

(2) Rough Processing

Figure 6:
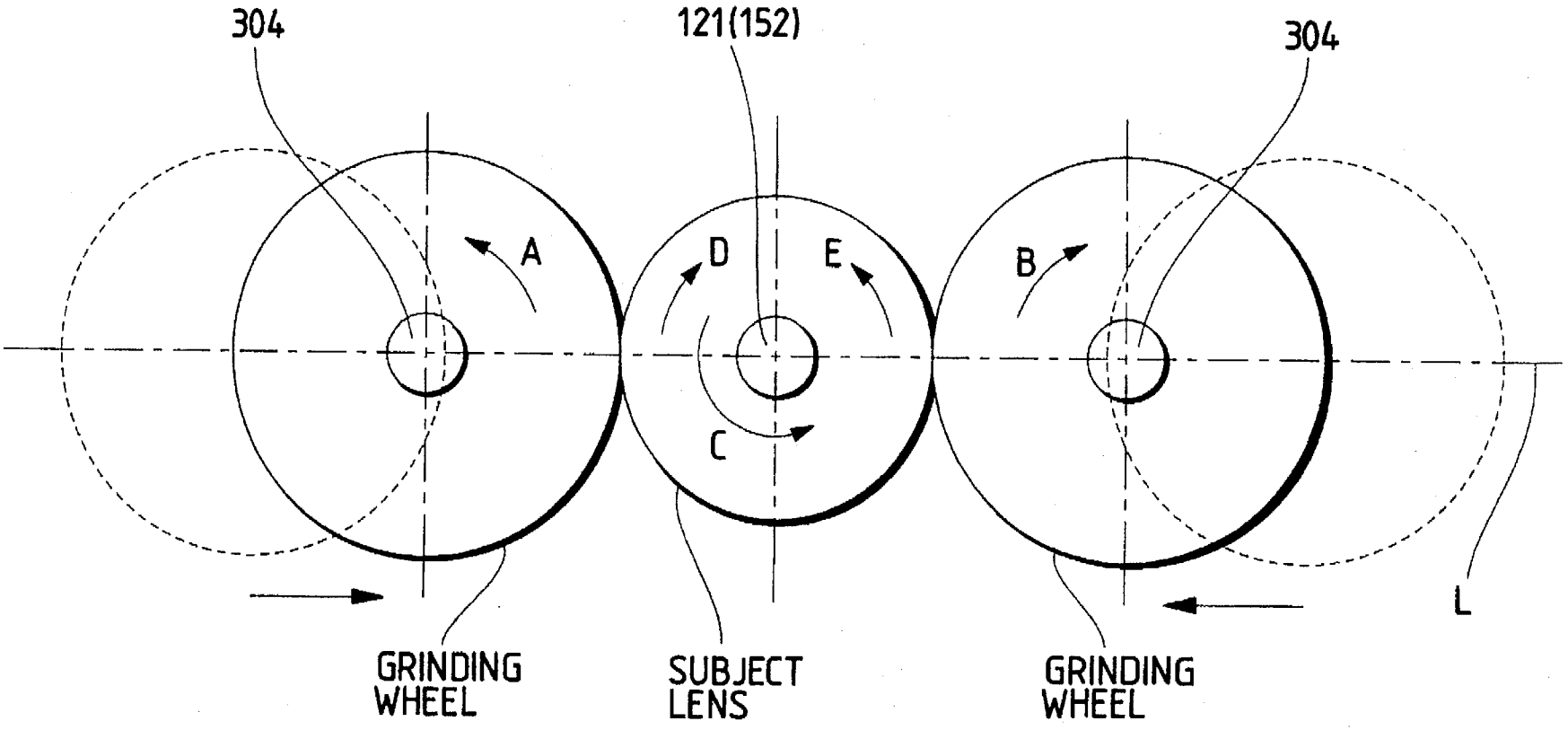
FIG. 6 illustrates a relationship between the directions of rotation of grinding wheels and a subject lens and rotational loads exerted on the subject lens.

Next, the control unit 600 performs rough processing based on the lens processing data. That is, the control unit 600 drives the servo motors 310R and 310L to rotate the grinding wheels. As shown in FIG. 6, the grinding wheels of the left lens grinding part 300L are rotated counterclockwise (indicated by arrow A shown in FIG. 6) while the grinding wheels of the right lens grinding part 300R are rotated clockwise (indicated by arrow B). Further, the control unit 600 drives the pulse motors 204R and 204L to lower the right and left vertical slide bases 210, and causes both of the right and left rough grinding wheels 30 to be located at the same height as the subject lens by controlling the number of pulses applied to the pulse motors 204R and 204L. Then, the control unit 600 drives the pulse motors 214R and 214L to horizontally slide the lens grinding parts 300R and 300L toward the subject lens.

The right and left rough grinding wheels 30 are moved toward the subject lens while being rotated, thereby gradually grind the subject lens from the two directions. The amounts of movement of the right and left rough grinding wheels 30 are controlled independently based on the lens frame shape data. That is, the movement of the two rough grinding wheels 30 is toward the subject lens is controlled based on lens frame shape data of the directions where the two rough grinding wheels 30 exist (as defined with respect to the reference direction of the subject lens being held by the chuck shafts 121 and 152). In this embodiment, since the center (rotation axis) of the chuck shafts 121 and 152 and the centers (rotation axes) of the rotary shafts 304 of the two rough grinding wheels 30 are located on the same straight line, the right and left rough grinding wheels 30 are moved based on two shape data that are deviated from each other by 180°.

The control unit 600 monitors the torque (i.e., motor load current) of each of the two servo motors 310R and 310L through the drivers 622 and 625. When the control unit 600 has judged, through the above monitoring, that a given torque amount is imparted to each of the servo motors 310R and 310L, or has judged that the grinding surfaces of both right and left rough grinding wheels 30 have reached their processing positions, the control unit 600 synchronously drives the pulse motors 130 and 156 for the chuck shafts 121 and 152 to thereby start rotation of the lens being held by those chuck shafts (in the direction of arrow C in FIG. 6).

This grinding operation is so performed that a value obtained by subtracting the radius of the grinding wheel 30 from the distance between the rotation center of each grinding wheel 30 and the lens processing center (i.e., the center of the chuck shafts 121 and 152) coincides with a frame shape value (plus a bevel processing margin) corresponding to a rotation angle of the subject lens. This grinding operation is based on the rotation angle data of the lens (which is obtained from the number of pulses supplied to the servo motors 130 and 156). During the course of this continuous grinding operation, when the control unit 600 has judged, through the monitoring of the torque of the servo motors 310R and 310L, that the torque of either motor has reached a given upper limit, the control unit 600 stops driving the pulse motors 130 and 156 for the chuck shafts 121 and 152 to thereby stop the rotation of the subject lens, and also stops the movement toward the lens of the rough grinding wheel 30 for which the torque has reached the given upper limit (or causes the rough grinding wheel 30 to retract a little). This measure can prevent an excessive load from being exerted on the subject lens as well as avoid such troubles as lens breakage. When the movement of the rough grinding wheel 30 toward the lens is stopped, the torque of the servo motor 310R or 310L which rotates the rough grinding wheel 30 decreases. When the torque has decreased to a given torque-up permission level, the control unit 600 permits movement of the rough grinding wheel 30 toward the subject lens and again rotates the lens, to restart grinding.

As described above, the lens grinding apparatus performs rough processing on the subject lens by use of the two shafts that are located in the two respective directions deviated from each other by 180° based on the frame shape data while controlling the movement of the right and left rough grinding wheels 30 toward the lens (right-left direction) and the rotation of the lens with the monitoring of the torque of each of the servo motors 310R and 310L. In this manner, the rough processing is completed while the subject lens makes 0.5 to 1.5 rotations depending on the lens edge thickness and the grinding amount. This rough grinding operation can be completed in a shorter time than a rough grinding operation from one direction by use of one shaft. Further, as shown in FIG. 6, by rotating the right and left rough grinding wheels 30 in opposite directions, the directions of the rotational loads exerted on the subject lens can be canceled out each other (in FIG. 6, the left rough grinding wheel 30 rotating in the direction of arrow A exerts, on the lens, a rotational load in the direction of arrow D, and the right rough grinding lens 30 rotating in the direction of arrow B exerts a rotational load in the direction of arrow E). As a result, the rigidity of the apparatus with respect to the lens torsion is increased, whereby it becomes possible to realize highly accurate processing. Further, since the upper and lower chuck shafts 121 and 152 for holding the subject lens are rotated synchronously by the independent motors 130 and 156, the torsion of the lens can be reduced from the case of a rotational mechanism in which the two chuck shafts are rotated by a single motor. This also contributes to improving the processing accuracy.

(3) Bevel Processing

Upon completion of the rough processing, bevel processing is started automatically. The control unit 600 drives the moving mechanisms for the lens grinding parts 300R and 300L so as to disengage the two rough grinding wheels 30 from the lens. The lens grinding part 300R is returned back to its original position and the rotation of the grinding wheels are stopped. On the other hand, the left lens grinding part 300L is moved based on the bevel processing data stored in the data memory 603 so that the V-groove of the finishing grinding wheel 31 is set at a height of an intended bevel shape of the lens. (Alternatively, first the lens grinding part 300L may also be returned to its original position, and then it may be moved toward the lens). Thereafter, bevel processing is performed such that based on the bevel processing data, the motor 214L is drive-controlled to move the finishing grinding wheel 31 in the right-left direction (toward the lens) and the motor 204L is drive-controlled to move the finishing grinding wheel 31 vertically. During the course of this operation, the control unit 600 monitors the torque of the servo motor 310L in the same manner as in the rough processing. When the control unit 600 has judged, through the torque monitoring, that the torque of the servo motor 310L has reached a given upper limit, it stops the movement of the finishing grinding wheel 31 and the rotation of the lens. When the control unit 600 has judged that the torque of the servo motor 310L has decreased to a given torque-up permission level, it restarts the movement of the finishing grinding wheel and the rotation of the lens. In this manner, the bevel processing is performed on the whole peripheral edge of the subject lens.

(4) Chamfering

In a chamfering operation, the control unit 600 calculates, in consideration of a given chamfering amount (for instance, 0.3 mm), chamfering data (for the front and rear surfaces) by using front surface and rear surface curve data that are produced based on the measured data of the lens measuring section 400 (curves are obtained by substituting the measured data into a general formula of a spherical surface and solving the resulting simultaneous equations) and longitudinal line data that are produced based on the layout data, the lens frame shape data, and other data (as described above, in the present embodiment the point on the lens optical axis is employed as the origin). (Alternatively, there may be prepared a table which correlates the cutting amount of chamfering with the curve and the distance from the center of processing). To carry out the chamfering operation, the vertical and horizontal movement of the front surface chamfering grinding wheel 32 and rear surface chamfering grinding wheel 33 are controlled based on the chamfering data. As for front and rear surface curve data of an aspherical lens, it is preferable to calculate curves for respective longitudinal lines. However, a low-diopter astigmatic lens may be considered a spherical surface.

First, the lens grinding apparatus performs a front surface chamfering operation. That is, the control unit 600 moves the front surface chamfering grinding wheel 32 of the left lens grinding part 300L in the vertical direction so that the grinding wheel 32 is set at a chamfering height of the front surface shoulder portion of the subject lens, and moves, while rotating it, the front surface chamfering grinding wheel 32 toward the lens based on the chamfering data. Thereafter, the control unit 600 rotates the subject lens, and controls the vertical and horizontal movement of the chamfering grinding wheel 32 based on the front surface chamfering data, to thereby chamfer the whole periphery of the lens. Since the chamfering grinding wheel 32 has a relatively smaller diameter, it can chamfer most of lenses without contacting with any portions other than the portion to be chamfered.

Upon completion of the front surface chamfering operation, the rear surface chamfering grinding wheel 33 is set at a chamfering height of the rear surface shoulder portion of the subject lens, and a chamfering operation is carried out based on the rear surface chamfering data in the same manner as in the above operation.

Since the chamfering grinding wheel mounted on the same shaft (rotation axis) as the other grinding wheels is used in this embodiment, the chamfering can be carried out efficiently without the need of a complicated chamfering mechanism.

The foregoing description is directed to the case ordinary bevel processing with the finishing grinding wheel 31. Where mirror finishing is performed, the mirror-finishing grinding wheel 34 and the mirror-chamfering grinding wheels 35 and 36 of the right lens grinding part 300R are used.

As for the grinding wheels mounted on the two rotary axes, various combinations other than those of the above embodiment may be employed. For example, for processing of a glass lens, grinding wheels for glass may be used in place of the rough grinding wheels 30 for plastics. Alternatively, grinding wheels for glass may be added to the above-described grinding wheel combinations with the two rotary shafts.

While in the above embodiment the bevel processing is performed with the finishing grinding wheel 31 that is mounted on one shaft, another finishing grinding wheel 31 may be mounted also on the right lens grinding part 300R to perform the bevel processing from the two directions with the two shafts in the same manner as in the rough processing. In this case, the bevel processing time, that is, the total processing time can be shortened. Further, chamfering grinding wheels of the same configuration may be provided on the right and left sides, and chamfering operations on the rear surface side and the front surface side of the lens may be carried out at the same time.

In addition, although the chamfering amount is previously set at a given value in the above embodiment, a key to be used for specifying a chamfering amount may be provided in the input unit 11. In this case, it is more effective to add a chamfering simulation function to a function of simulating a virtual bevel shape of a certain bevel processing data based on lens edge thickness measurement data (see Japanese Unexamined Patent Publication No. Hei. 3-20603), which function is provided in an apparatus that allows specification of a curve and a position of a bevel shape.

What is claimed is:

1. A lens grinding apparatus for performing frame-fit processing on an eyeglass lens, comprising:

input means for receiving data necessary to produce frame-fit processing data:

lens holding shafts for holding a subject lens in between;

means for rotating the lens holding shafts;

a plurality of grinding-wheel shafts on each of which at least one grinding wheel for rough processing and one grinding wheel having a V-shaped groove for bevel processing are mounted:

means for rotating each of the plurality of grinding-wheel shafts;

first moving means for moving the plurality of grinding-wheel shafts toward a rotation axis of the lens holding shafts, to grind the subject lens; and control means for independently controlling the grinding-wheel shafts moving means based on the frame-fit processing data.

2. The lens grinding apparatus as set forth in claim 1, wherein the plurality of grinding-wheel shafts are two grinding-wheel shafts, and wherein the grinding wheel shafts rotating means rotates the two grinding-wheel shafts in opposite directions so that rotational loads are exerted on the subject lens in opposite directions.

3. The lens grinding apparatus as set forth in claim 2, wherein rotation axes of the two grinding-wheel shafts are located on the same line passing through the rotation axis of the lens holding shafts at opposite sides thereof.

4. The lens grinding apparatus as set forth in claim 1, wherein the lens holding shafts are disposed vertically.

5. A lens grinding apparatus for performing frame-fit processing on an eyeglass lens, comprising:

input means for receiving data necessary to produce frame-fit processing data:

lens holding shafts for holding a subject lens in between;

means for rotating the lens holding shafts;

a plurality of grinding-wheel shafts on each of which at least one grinding wheel for lens grinding is mounted:

means for rotating each of the plurality of grinding-wheel shafts;

first moving means for moving the plurality of grinding-wheel shafts toward a rotation axis of the lens holding shafts, to grind the subject lens; and control means for controlling the grinding-wheel shafts moving means based on the frame-fit processing data, wherein the lens holding shafts rotating means rotates the lens holding shafts individually and synchronously.

6. A lens grinding apparatus for performing frame-fit processing on an eyeglass lens, comprising:

input means for receiving data necessary to produce frame-fit processing data:

lens holding shafts for holding a subject lens in between;

means for rotating the lens holding shafts;

a plurality of grinding-wheel shafts on each of which at least one grinding wheel for lens grinding is mounted:

means for rotating each of the plurality of grinding-wheel shafts;

first moving means for moving the plurality of grinding-wheel shafts toward a rotation axis of the lens holding shafts, to grind the subject lens; and control means for controlling the grinding-wheel shafts moving means based on the frame-fit processing data, wherein the grinding-wheel shafts rotating means includes means for detecting torque of motors for respectively rotating the plurality of grinding-wheel shafts, and the control means causes the grinding-wheel shafts moving means to stop moving the plurality of grinding-wheel shafts toward the subject lens when the torque of at least one of the motors has reached an upper limit value.

7. A lens grinding apparatus for performing frame-fit processing on an eyeglass lens, comprising:

input means for receiving data necessary to produce frame-fit processing data:

lens holding shafts for holding a subject lens in between;

means for rotating the lens holding shafts;

a plurality of grinding-wheel shafts on each of which at least one grinding wheel for lens grinding is mounted:

means for rotating each of the plurality of grinding-wheel shafts;

first moving means for moving the plurality of grinding-wheel shafts toward a rotation axis of the lens holding shafts, to grind the subject lens;

control means for controlling the grinding-wheel shafts moving means based on the frame-fit processing data; and second moving means for moving the plurality of grinding-wheel shafts in a longitudinal direction thereof relative to the subject lens, wherein the control means further controls the second moving means based on the frame-fit processing data.

8. The lens grinding apparatus as set forth in claim 5, wherein the plurality of grinding-wheel shafts are two grinding-wheel shafts, and wherein the grinding-wheel shafts rotating means rotates the two grinding-wheel shafts in opposite directions so that rotational loads are exerted on the subject lens in opposite directions.

9. The lens grinding apparatus as set forth in claim 8, wherein rotation axes of the two grinding-wheel shafts are located on the same line passing through the rotation axis of the lens holding shafts at opposite sides thereof.

10. The lens grinding apparatus as set forth in claim 5, wherein the lens holding shafts are disposed vertically.

11. The lens grinding apparatus as set forth in claim 6, wherein the plurality of grinding-wheel shafts are two grinding-wheel shafts, and wherein the grinding-wheel shafts rotating means rotates the two grinding-wheel shafts in opposite directions so that rotational loads are exerted on the subject lens in opposite directions.

12. The lens grinding apparatus as set forth in claim 11, wherein rotation axes of the two grinding-wheel shafts are located on the same line passing through the rotation axis of the lens holding shafts at opposite sides thereof.

13. The lens grinding apparatus as set forth in claim 6, wherein the lens holding shafts are disposed vertically.

14. The lens grinding apparatus as set forth in claim 7, wherein the plurality of grinding-wheel shafts are two grinding-wheel shafts, and wherein the grinding-wheel shafts rotating means rotates the two grinding-wheel shafts in opposite directions so that rotational loads are exerted on the subject lens in opposite directions.

15. The lens grinding apparatus as set forth in claim 14, wherein rotation axes of the two grinding-wheel shafts are located on the same line passing through the rotation axis of the lens holding shafts at opposite sides thereof.

16. The lens grinding apparatus as set forth in claim 7, wherein the lens holding shafts are disposed vertically.

17. The lens grinding apparatus as set forth in claim 5, wherein said plurality of grinding-wheel shafts each have at least one grinding wheel for rough processing and one grinding wheel having a V-shaped groove for bevel processing mounted thereon.

18. The lens grinding apparatus as set forth in claim 6, wherein said plurality of grinding-wheel shafts each have at least one grinding wheel for rough processing and one grinding wheel having a V-shaped groove for bevel processing mounted thereon.

19. The lens grinding apparatus as set forth in claim 7, wherein said plurality of grinding-wheel shafts each have at least one grinding wheel for rough processing and one grinding wheel having a V-shaped groove for bevel processing mounted thereon.

* * * * *

UNITED STATES PATENT AND TRADEMARK OFFICE

CERTIFICATE OF CORRECTION

PATENT NO. : 5,716,256

DATED : February 10, 1998

INVENTOR(S) : Toshiaki Mizuno et al

It is certified that error appears in the above-identified patent and that said Letters Patent is hereby corrected as shown below:

Title page, item [56] References Cited, please add the following Foreign Documents.

| FOREIGN PATENT DOCUMENTS | | | | | | | |
|---|---|---|---|---|---|---|---|
| | | | | | | | |
| | | 2117287A | 10/12/83 | Great Britain | | | |
| | | 1462697 | 11/7/66 | France | | | |
| | | 3814670A | 11/9/89 | Germany | | | |
| | | | | | | | |
| | | | | | | | |
| | | | | | | | |

Signed and Sealed this

Third Day of November, 1998

*Attest:*

*Attesting Officer*

Bruce Lehman

BRUCE LEHMAN

*Commissioner of Patents and Trademarks*